United States Patent [19]

Brackmann et al.

[11] 3,960,645

[45] June 1, 1976

[54] METHOD AND APPARATUS FOR THE OPENING OF TOW

[75] Inventors: Warren A. Brackmann, Cooksville; Daniel Dilanni, Toronto, both of Canada

[73] Assignee: Rothmans of Pall Mall Canada Limited, Toronto, Canada

[22] Filed: Jan. 21, 1975

[21] Appl. No.: 542,715

[30] Foreign Application Priority Data

Jan. 28, 1974 United Kingdom ..... 3927/74

[52] U.S. Cl. ..... 156/441; 28/1 CF; 93/1 C; 93/77 FT; 156/180; 156/229; 156/494

[51] Int. Cl.[2] ..... A24C 5/50

[58] Field of Search ..... 156/160, 161, 494, 441, 156/229, 178, 180, 181, 344, 581; 19/66 T, 65 T; 28/1 CF; 93/1 C, 77 FT; 204/210 F, 290 R

[56] References Cited

UNITED STATES PATENTS

| | | | |
|---|---|---|---|
| 3,156,016 | 11/1964 | Dunlap et al. | 28/1 CF |
| 3,413,698 | 12/1968 | Fritz et al. | 28/1 CF |
| 3,707,415 | 12/1972 | Golladay et al. | 156/172 |
| 3,741,846 | 6/1973 | Greve | 156/441 |
| 3,744,108 | 7/1973 | Greve | 28/1 CF |

FOREIGN PATENTS OR APPLICATIONS

| | | | |
|---|---|---|---|
| 1,902,954 | 8/1970 | Germany | 93/77 FT |

*Primary Examiner*—William A. Powell
*Assistant Examiner*—Michael W. Ball
*Attorney, Agent, or Firm*—Sim & McBurney

[57] ABSTRACT

The tension of tow fed to the nip of a pair of differential stretching rollers is controlled by drag rollers. The inertia of the drag rollers limiting their speed of response to tow density changes is compensated for by maintaining the tension at a constant value during periods of speed up and slow down of the drag rollers by utilization of an inertialess means for applying force to the tow between the drag rollers and the differential stretching rollers.

11 Claims, 2 Drawing Figures

METHOD AND APPARATUS FOR THE OPENING OF TOW

FIELD OF INVENTION

The present invention is directed to the opening of tow for the production of cigarette filter rod sections.

BACKGROUND TO THE INVENTION

In the production of cigarette filters, tow, such as cellulose acetate tow, which consists of a large number of crimped continuous filaments, is opened, is passed through a chamber in which plasticizer is applied to the tow, and thereafter is treated to reduce its cross-sectional size until it is approximately equal to the cross-sectional size of a cigarette. The condensed mass is formed into a coherent structure, typically by wrapping paper round it, and ultimately is cut into plugs of suitable length for incorporation directly into cigarettes or into a filter tip-applying machine.

One widely-used method of opening the tow consists of subjecting the tow, while being fed along a predetermined path, to a differential gripping action between a plurality of points spaced from one another transversely of the path so that certain laterally-spaced sections of the tow are positively gripped relative to other laterally-spaced sections of the tow. In this manner, there is produced, as a function of the differential positive gripping of the tow, a relative shifting of adjacent filaments longitudinally of the tow, whereby the crimps are moved out of registry with one another. The longitudinal relative displacement of the fibers usually is combined with a relative lateral displacement between adjacent filaments of the tow, whereby the combinations of the two relative filament movements brings about the complete opening of the tow.

This differential gripping action is accomplished by the provision, before the plasticizing chamber, of a pair of rollers, one of which is smooth surfaced and the other of which is grooved over its entire periphery. The tow is maintained under tension upstream of the differential gripping action so that after release of the tension on the downstream side of the differential gripping action, the tow blooms into a fluffy band which then passes through the plasticizer applying chamber, optionally after further lateral opening of the tow band, prior to feed to the filter rod-making machine.

Generally, the density of tow varies over a wide range and hence a feed of tensioned tow directly to the differential gripping rollers results in variations in weight per unit length of filter rod. This is undesirable since the resistance which filter rod sections including such variations offer to the passage of cigarette smoke varies, rendering inconsistent the draw characteristics of cigarettes to which filter tips formed from such filter rod sections are applied. It is usual, therefore, to attempt to control the density of the tow prior to formation of the filter rod.

It has previously been suggested to provide a filter rod making machine with pretensioning means to provide the tow to the differential gripping rollers at a substantially constant tension, and thereby decrease the difference between the densities of successive increments of the tow which subsequently is subjected to the stretching action. This pretensioning has been achieved by the use of a set of drag rollers upstream of the differential gripping rollers, the speed of rotation of the drag rollers being controlled by the speed of rotation of the differential gripping rollers and suitable braking means associated with the drag rollers. The braking is applied by the constant force applied by an upper roller against a lower roller having a compressible surface, thereby attempting to achieve a substantially even tension, and hence density, in the feed of the tow to the differential gripping rollers.

At high speeds of operation of filter rod-making machines, the response time of the constant braking action to variations in tow density is long, due at least in part to the inherent inertia of the pretensioning or drag rollers, causing variations in tow density fed to the differential gripping rollers, albeit variations which are less great than those in the original tow.

Such variations have led to sophisticated electronically-actuated control systems, such as are described in U.S. Pat. Nos. 3,741,846 and 3,613,975, to control the speed of drive motors for the pretensioning rollers to obtain a substantially even density feed of tow to the differential gripping rollers. However, such sophisticated control systems are complicated and expensive.

SUMMARY OF INVENTION

In accordance with the present invention, there is provided a mechanical system which acts to maintain a substantially uniform tension on the tow which is fed to the differential gripping rollers in high speed operation and which compensates for the slow response of the drag rollers to variations in density of the tow. The system is effective at low speeds of operation, but is particularly useful during high speed operation of the filter rod-making machine.

DESCRIPTION OF PREFERRED EMBODIMENT

Figures 1, 2:
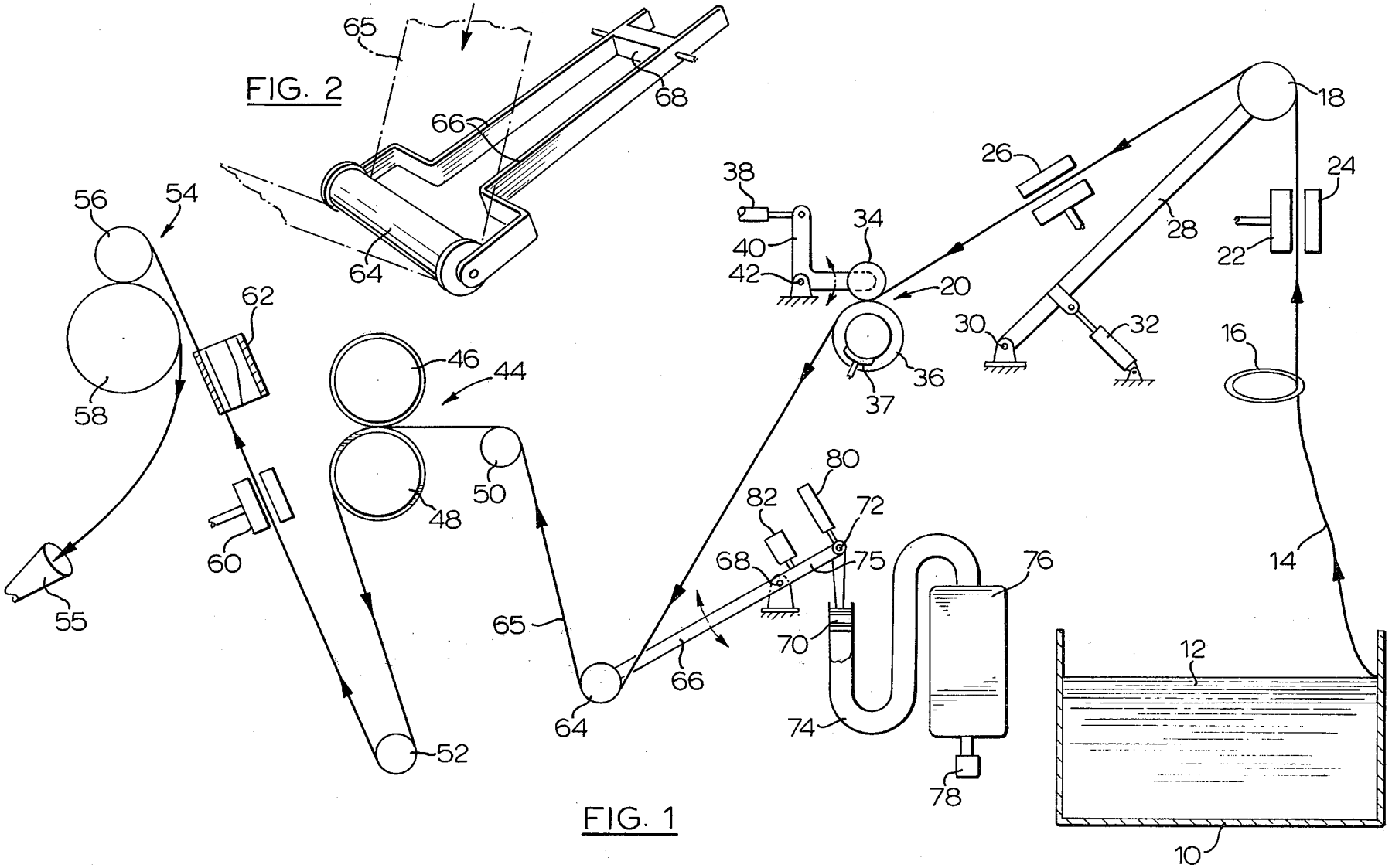
FIG. 1 is a schematic side elevational view of one embodiment of the invention.
FIG. 2 is a perspective view of the lever arm and roller arrangement used in the embodiment of FIG. 1.

Referring to the drawing, a refillable container 10 contains a bale 12 of unopened tow in the form of a continuous strand of crimped filamentary filter material which is to be converted into filter rod. The strand 14 of tow material is drawn first upwardly through a fixed control loop 16, then about an idler roller 18 before passing inclinedly downwardly to the nip of a pair of drag rollers 20. During passage from the bale 12 to the idler roller 18, the tow passes a first nozzle 22 connected to a source of compressed air and situated opposite a plate 24. The nozzle 22 directs compressed air across the path of the tow 14 in order to loosen or open the filaments and impart to the tow the shape of a band. A second nozzle and plate arrangement 26 is situated between the idler roller 18 and the drag rollers 20 to loosen or open further the filaments of the tow, prior to the drag rollers 20.

The idler roller 18 is mounted at one end of a boom 28 which is arcuately movable about pivot 30 by the action of pneumatic cylinder 32. Movement of the boom 32 controls the angle of approach of the tow 14 to the nip between the rollers 20.

The first pair of rollers 20 includes an upper roller 34 and a lower roller 36. In contrast to the prior art drag rollers, each of the rollers 34 and 36 is provided with an incompressible and preferably non-slip surface and the pressure in the nip between the rollers 34 and 36 is controlled to provide enough force only to grip the tow in the nip but insufficient to provide any significant braking action. The pressure in the nip between the rollers 34 and 36, therefore, is sufficient to provide a friction grip on the tow in the nip. The upper roller 34 is movable by the action of pneumatic cylinder 38, crank arm 40 and pivot 42 between locations of greater or lesser pressure loadings on the nip between rollers 20.

The lower roller 36 is provided with an air actuated brake 37 for applying greater or lesser amounts of braking force to the lower roller 36 to control the rate of flow of tow through the nip between the rollers 20.

The tow 14 passes in tension from the rollers 20 to the nip of differential gripping rollers 44 which may be in the form of an upper grooved steel roller 46 and a lower smooth surfaced rubber roller 48. The lower roller 48 is driven at any desired speed, in any convenient manner, not shown. To feed tow tangentially to both rollers 46 and 48 in the nip, an idler roller 50 of fixed position is provided upstream of the rollers 44.

Upon release of the tension on the tow band on the downstream side of the differential gripping rollers 44, the tow fibers bloom. The bloomed tow passes from the rollers 44 about an idler roller 52 and about a pair of delivery rollers 54 before the opened tow passes to the conical entrance 55 of a filter rod-making machine (not shown) for formation of filter rod from the opened tow in conventional manner.

The rollers 54 include an upper roller 56 and a lower roller 58, the lower roller 58 being driven, typically controlled by the speed of operation of the filter rod-making machine.

During passage of the opened tow from the rollers 44 to the rollers 54, the tow is subjected to a further blooming jet 60 to widen or open further the band of tow before passage through a plasticizer 62 of any convenient construction for spray or other suitable application of plasticized adhesive to the tow.

In accordance with the present invention, a roller 64 is supported in contact with the top surface of the tow band between the pretensioning or drag rollers 20 and the differential gripping rollers 44, the tow between rollers 20 and 44 being in a downward loop 65 as illustrated.

The roller 64 typically is hollow and is very light and hence is substantially inertialess. The roller 64 is supported at one end of a substantially inertialess lever arm 66 for arcuate movement about a pivot 68.

The inertialess roller 64 typically is rotatably mounted between a pair of arms 66, which extend from the pivot 68 and are spaced apart a distance wider than the width of the tow band 14 in the loop 65 at least adjacent the interialess roller 64.

A piston 70 is pivotably mounted by pivot 72 to an extension of the lever arm 66 and is situated in an air cylinder 74. The extension 75 of the lever arm 66 preferably is very short in order to minimize the inertia of this portion of the system. The piston/air cylinder combination 70, 74 serve to apply a constant load to the roller 64. A small upward or downward movement of the piston 70 results in much larger changes in the position of the roller 64.

Any other convenient load-applying means for the inertialess roller 64 may be utilized in place of the piston/air cylinder combination, to provide a constant force to the roller 64 including a heavy weight or the like attached to the lever arm 66 but spaced from the pivot 68.

An air reservoir 76 is provided associated with the air cylinder 74 to maintain a large air cushion in the system to absorb shock waves upon sudden motion of the piston 70. An air evacuation valve 78 is associated with the air reservoir 76 for evacuation of air therefrom.

An emergency brake 80 also is connected to the pivot 72 for limiting arcuate movement of the lever arm 66 under emergency conditions, such as upon breakage of the tow.

The roller 64 supported in this manner and engaging the upper surface of the tow 14 in the loop 65 compensates for the variations in tension introduced to the tow between the rollers 20 and 44 by the inertia of the rollers 20 which prevents them from reacting instantaneously to changes in tow density, and thereby there is provided a substantially constant tension to the tow fed to the differential stretching rollers 44.

Thus, as the drag rollers 20 slow down in response to an increase in tow density to feed lesser amounts of tow to the rollers 44, the lag in change of roll speed, due to the inertia of the drag rollers 20, is taken up by the roller 64 which pivots downwardly about the pivot 68 under the influence of the force applied to the roller 64 by the piston 70, thereby to accumulate the excess tow not required by the rollers 44 while maintaining the tension in the tow between the drag rollers 20 and the differential gripping rollers 44 substantially constant until the drag rollers 20 can assume their appropriate speed. Similarly as the drag rollers 20 speed up in response to a decrease in tow density to feed greater amounts of tow to the rollers 44, the lag in change in roll speed is taken up by the inertialess roller 64 which pivots upwardly about the pivot 68 against the force applied by the piston 70 to provide the extra tow required while maintaining a substantially constant tension between the drag rollers 20 and the differential gripping rollers 44.

In most cases, the nature of the density variations in the tow are such that the inertialess roller 64 would continue to accumulate or give up tow, as the case may be, for an extended period of time, unless additional steps are taken to control the flow of tow through the nip between the drag rollers 20.

Sensing means 82, therefore, is positioned to sense locations of the lever arm 66, typically by sensing locations of the extension 75 as illustrated. The sensing means 82 in any suitable manner commensurate with the form thereof actuates the brake 37 on the drag rollers 20 once a predetermined arcuate movement of the lever arm 66 has occurred, typically about 15 degrees of arc in either direction.

The sensing means 82 produces variable output signal which produces a progressively increasing braking force applied by the brake 37 with continued downward movement of the roller 64 and a progressively decreasing braking force with continued upward movement of the roller 64, as the case may be.

The application of greater or lesser braking force as required controls the speed of the drag rolls 20 to the required value for the tow density. The roller 64 then is restored to its original location between the predetermined limits, thereby inactivating the sensing means.

Thus, in the apparatus of the invention, alteration of the speed of rotation of the drag rollers 20 occurs over a relatively long period of time through the air-actuated brake 37 which applies lesser or greater braking force to the drag rollers 20 as required by variations in tow density, while the otherwise-arising momentary variations in tow tension between the drag rollers 20 and the differential gripping rollers 44 are eliminated by movement of the inertialess rollers 64 in an upward or downward direction, as required.

The sensing means 82 may be operable for all arcuate positions of the lever arm 66, but it is preferred to operate with an inactive or neutral zone of arcuate movement of the lever arm 66. The sensing means 82 may be of any convenient construction to a variable signal output to cause a gradually increasing or a gradually decreasing braking applied through brake 37 with increasing arcuate movement of the lever arm 66 away from the neutral zone.

Typically the sensing means 82 may be an electrical switch having a rod actuator engaging the lever arm and associated with a rheostat to provide an electrical output signal of magnitude proportional to the arcuate location of the arm 66. Alternatively, the sensing means 82 may be an air valve providing an air pressure output to the air-operated actuator of the brake 37, the value of the air pressure output varying in accordance with the location of the lever arm 66.

SUMMARY

The present invention, therefore, is capable of maintaining, in simple and precise manner, without the necessity of the sophisticated electronic control systems of the prior art, the tension of the tow fed to differential gripping rollers and is able to compensate for the inertia-controlled response to changes in tow density of drag rollers controlling the tow tension. Therefore, the present invention provides opened tow having a more uniform density along its length and hence is able to provide cigarette filters having consistent draw properties. Modifications are possible within the scope of the present invention.

What we claim is:

1. A tow opening mechanism comprising differential gripping means for gripping selected portions only of the width of a band of tow material composed of a plurality of longitudinally-extending crimped fibres to achieve relative longitudinal shifting of adjacent fibres of the tow under the application of tension to the tow band upstream of said differential gripping means, drag means located upstream of said differential gripping means and arranged to apply tension to the tow between said drag means and said differential gripping means, said drag means comprising a first pair of upper and lower rollers mounted for free-wheeling rotation and arranged to grip tow passing through the nip between the rollers, brake means operatively associated with at least one of said upper and lower rollers for applying a variable braking force to said at least one roller, brake actuation means operatively connected to said brake means for actuation of said brake means, means for controlling the pressure of one of said pair of rollers on the other to control the force applied to the tow passing through the nip between the rollers, means establishing a flow path of said band of tow between said drag means and said differential gripping means including a generally U-shaped portion when viewed in side elevation, said brake means controlling the rate of flow of tow from said drag means into said flow path in accordance with the speed of rotation of said upper and lower rollers, an elongate substantially inertialess cylindrical member having its axis extending generally horizontally with said cylindrical member engaging the upper surface of the tow band in the trough of said generally U-shaped portion of said flow path whereby the axis of said cylindrical member extends laterally of said tow band, said cylindrical member forming part of said means establishing a flow path, substantially inertialess lever arm means including a pair of arm members of substantially equal length passing one each side of the lateral edges of said tow band in said U-shaped portion, means mounting said cylindrical member to said pair of lever arm members adjacent one end of said lever arm means, pivot means located to the underside of one of the arms of the U-shaped tow band portion when viewed in side elevation and pivotally mounting said pair of lever arm members at a location remote from said one end thereof for arcuate movement of said pair of lever arm members about a substantially horizontal axis parallel to the axis of said cylindrical member, force-producing means connected to said lever arm means at a position closer to said pivot means than said cylindrical member on the side of said pivot opposite said cylinder member for providing constant downward force on said tow band in said generally U-shaped portion through said cylindrical member, and arcuate position sensing means including means engaging said lever arm means to detect the arcuate position of said lever arm means and thereby arranged to sense arcuate movement of said lever arm means, variable output means actuated by said engagement means for producing an output signal corresponding in strength to the positions of said engagement means and hence corresponding to the arcuate position of said lever arm means, said variable output means being inactive for predetermined positions of said engagement means corresponding to small angular displacements of said lever arm means and active for positions of said engagement means other than said predetermined positions corresponding to larger angular displacements of said lever arm means, and means operatively connecting said variable output means to said brake actuation means for activation of said brake means to apply said braking force to said at least one roller corresponding to the strength of said output signal and achieve said control of said rate of flow of tow from said drag means into said flow path.

2. The mechanism of claim 1 wherein said variable output means includes an air pressure valve and said output signal is provided by air pressure passing through said air pressure valve.

3. The mechanism of claim 1 wherein said variable output means produces an output signal which increases in value in a direction of movement of said lever arm and said inertialess cylindrical member downwardly from the predetermined positions corresponding to said predetermined positions of said engagement means to increase progressively said braking force on said first pair of rollers and said output signal decreases in value in a direction of movement of said lever arm and said inertialess cylindrical member upwardly from said predetermined positions thereof to decrease progressively said braking force on said first pair of rollers.

4. The mechanism of claim 1 including emergency brake means connected to said lever arm means to arrest undue arcuate movement of said lever arm means.

5. The mechanism of claim 1 wherein said lever arm means extends beyond said pivot means in a direction generally linearly opposite to the direction of extension of said arm members and for a short distance as compared to the distance of extension of said arm members, said force-producing means being mounted substantially at the outer extremity of said extension.

6. The mechanism of claim 5 wherein said force-producing means includes a piston, an air cylinder in which said piston is mounted for reciprocation, means producing air pressure against said piston in said air cylinder, and an air reservoir in fluid flow communication with said air cylinder for absorbing shocks arising from sudden movement of said piston, said air pressure acting on said piston for application of a substantially constant force at said outer extremity of said extension, thereby to provide said substantially constant downward force on said tow band in said trough through said cylindrical member.

7. The mechanism of claim 1 wherein said differential gripping means comprises a second pair of upper and lower rollers arranged to grip the band of tow passing through the nip between the rollers.

8. The mechanism of claim 2 including a third pair of upper and lower rollers downstream from said second pair of upper and lower rollers arranged to grip tow passing through the nip between the rollers and to receive opened tow from said second pair of rollers and first blooming jet means located between said second and third pairs of rollers and arranged to stretch the fibres of said tow laterally, and plasticized adhesive supplying means located between said second and third pair of rollers and downstream of said first blooming jet means and arranged to apply plasticized adhesive to said tow, each member of said second and third pairs of rollers being mounted for rotation about a horizontal axis, the horizontal axes of rotation of the members of each pair being parallel and lying in a substantially vertical plane.

9. The mechanism of claim 8 including an idler roller located out of the direct path from the second pair of rollers to the third pair of rollers and about which said tow passes to establish a flow path length of said tow between said second and third pairs of rollers which is longer than said direct path.

10. The mechanism of claim 8, wherein each member of said first pair of rollers is mounted for rotation about a horizontal axis which lies in the common vertical plane of the horizontal axes of said second and third pairs of rollers.

11. The mechanism of claim 10 wherein said flow path establishing means includes an idler roller mounted downstream of said generally U-shaped section and adjacent said second pair of rollers for rotation about a horizontal axis lying in said common vertical plane and arranged to guide said tow band into the nip between said second pair of rollers substantially tangentially to both members of said second of rollers.

* * * * *